US005094291A

United States Patent [19]

Oswalt et al.

[11] Patent Number: 5,094,291

[45] Date of Patent: Mar. 10, 1992

[54] HEAT TRANSFER APPARATUS

[75] Inventors: Philip D. Oswalt; Ronald A. Wolfe, both of Indianapolis, Ind.

[73] Assignee: Advantage Engineering, Inc., Greenwood, Ind.

[21] Appl. No.: 626,903

[22] Filed: Dec. 13, 1990

[51] Int. Cl.[5] ..... F24H 1/20

[52] U.S. Cl. ..... 165/104.31; 165/120; 415/121.3; 415/178; 392/471; 392/473; 392/488; 392/489

[58] Field of Search ..... 165/120, 104.31; 417/243; 415/121.3, 177, 178, 179; 392/471, 473, 488, 489

[56] References Cited

U.S. PATENT DOCUMENTS 1,882,266 10/1932 Wainwright ..... 417/243
2,377,027 5/1945 Morgan et al. ..... 392/471
4,129,178 12/1978 Hucke ..... 392/471

FOREIGN PATENT DOCUMENTS 698802 1/1932 France ..... 415/179

*Primary Examiner*—Albert W. Davis, Jr.
*Attorney, Agent, or Firm*—Woodard, Emhardt, Naughton Moriarty & McNett

[57] ABSTRACT

A combination pump and heat exchanger assembly uses a cast metal pump case with two upwardly opening sockets receiving the lower ends of two tubes, one of them communicating through the case with the pump impeller intake and the other with the impeller discharge. The tubes are constructed to function as heat exchanger units and are removably secured to the case by threaded fasteners and are sealed therein by compression seals. The heat exchanger tubes may employ electrical heating units or chilled liquid piping units therein.

9 Claims, 5 Drawing Sheets

HEAT TRANSFER APPARATUS

BACKGROUND OF THE INVENTION

This invention relates generally to heat transfer systems, and more particularly to a pump and heat exchanger assembly which is compact and easily maintained.

DESCRIPTION OF THE PRIOR ART

Typical heat exchanger systems for controlling the temperature of cooling water for various kinds of manufacturing machines employ fabricated tanks with heating and/or cooling coils in them and which are piped into a process water plumbing circuit including a pump, various valves and controls. The tanks involve a considerable amount of fabrication. Their combination with pumps and the associated plumbing also involves considerable labor, space demands, and the attendant problems of packaging into reasonably sized units, particularly where portability of the temperature controller assembly is desirable. There are also attendant maintenance problems.

SUMMARY OF THE INVENTION

Described briefly, according to a typical embodiment of the present invention, a combination pump and heat exchanger assembly is provided with the pump case serving as the mount for heat exchanger units and for the pump drive motor. The pump case has upwardly opening receptacles, one communicating with the impeller intake and the other with the impeller discharge. A tubular heat exchanger unit is mounted in each of the receptacles and is removably secured therein by threaded fasteners and sealed therein by compression seals. The heat exchanger units may employ electrical heaters or chilled liquid piping therein.

DESCRIPTION OF THE PREFERRED EMBODIMENT

Figure 1:
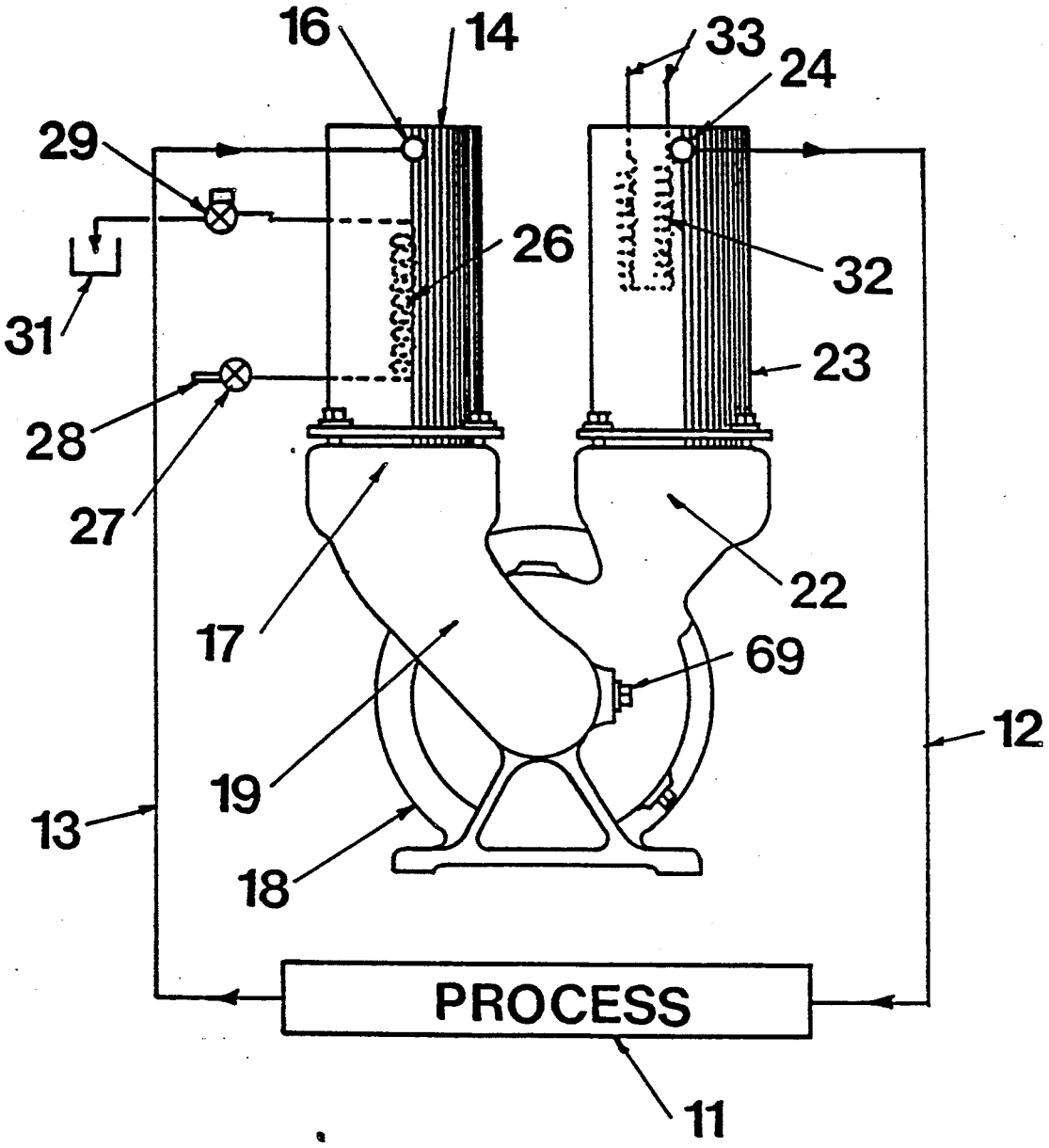
FIG. 1 is a symbolic diagram of a process cooling water circuit including the pump and heat exchanger assembly of the present invention therein.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 4:
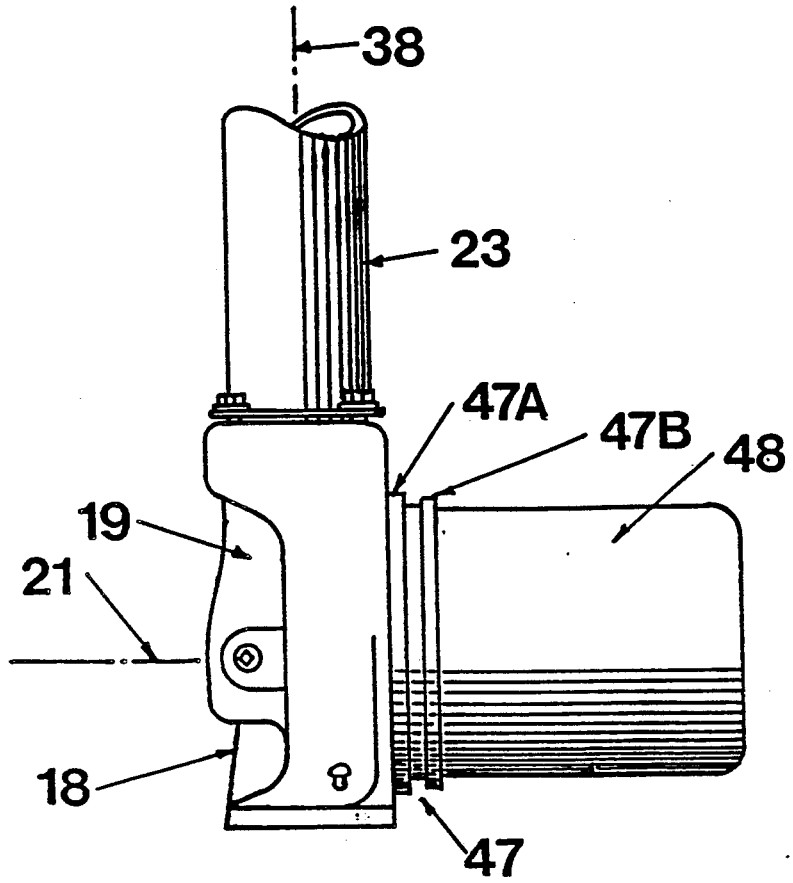
FIG. 4 is a small side elevational view of the pump and heat exchanger assembly with the upper portion of the heat exchangers eliminated to conserve space in the drawing, and showing the pump motor and adaptor mounted to the rear of the pump case.
Figure 5:
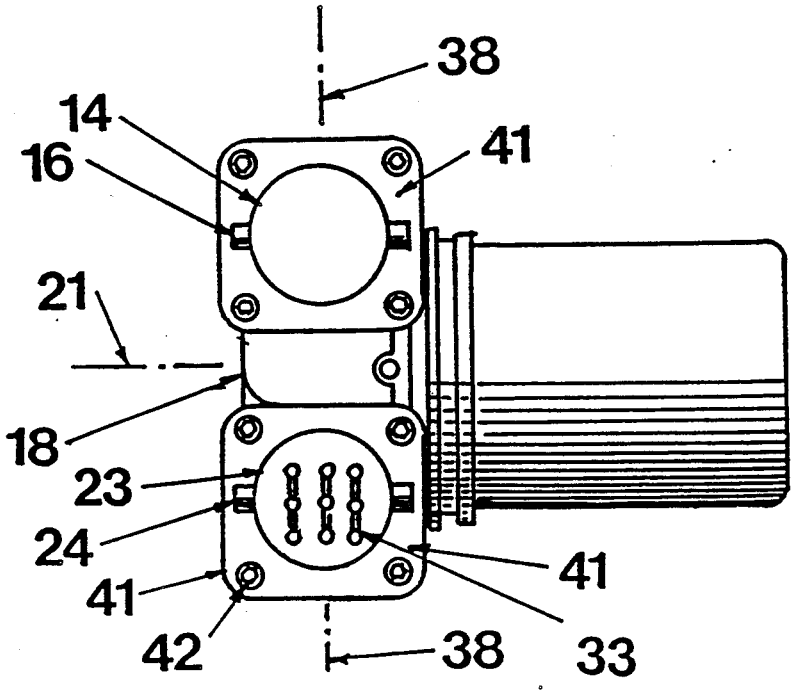
FIG. 5 is a top plan view of the same scale as FIG. 4.

Referring now to FIG. 1, the process equipment to be temperature-controlled as shown generally at 11. It may include injection molding machines, lasers, or other equipment requiring temperature control and in which water is usually used as the temperature controlling fluid. Water is supplied to the process through the line 12 and departs the process through the line 13 and enters the heat exchanger tube 14 through a spud opening 16 at the cylindrical wall thereof near the top. Tube 14 is received in an upwardly-opening receptacle 17 in the pump case 18 and which communicates through the passageway 19 to the pump intake on the axis 21 (FIGS. 4 and 5). The water is discharged through a similar upwardly opening receptacle 22 in which is received a tube 23. In the illustrated example, the process water is in a closed circuit. Therefore, a spud opening at 24 near the top of tube 23 is connected to the discharge line 12 supplying the process 11. Tubes 14 and 23 are heat exchanger tubes. In the illustrated example, the heat exchanger tube 14 is provided with means for cooling the water passing through it from the spud 16 into the pump case 18. The heat exchanger tube 23 is provided with means for heating the water discharged from the pump and departing through the spud 24. More specifically, a coiled tube 26 in heat exchanger tube 14 receives water through a valve 27 from a city water supply 28. This water moves upward in tube 25 an exits near the upper end of tube 26 and passes through a solenoid operated valve 29 which discharges to the sewer 31.

In the other heat exchanger tube 23, there is an electrical heating element 32 supplied by electrical power applied across the terminals 33.

Figure 2:
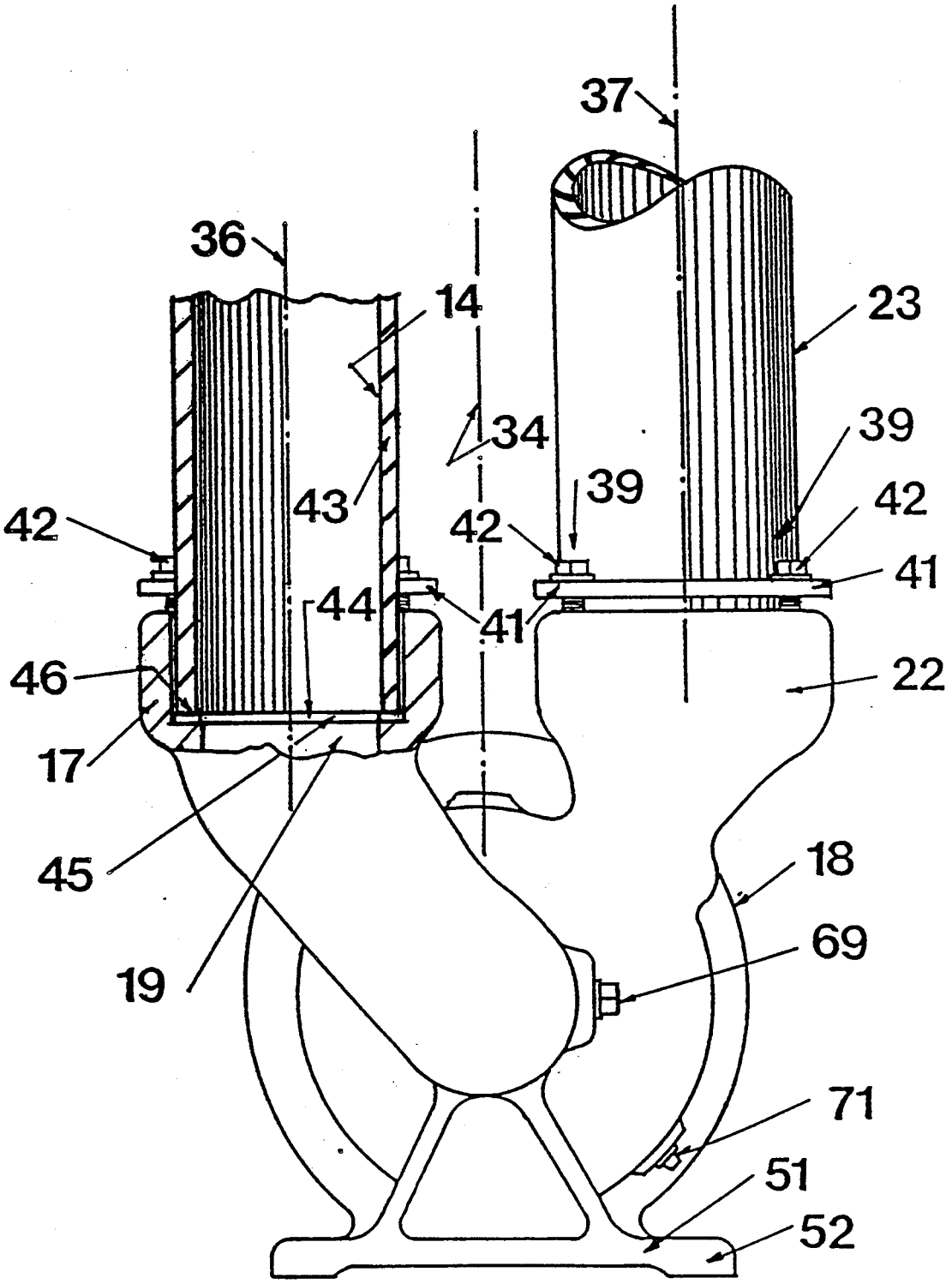
FIG. 2 is an enlarged elevational view of the pump intake end of the pump and heat exchanger assembly.

The pump case 18 is generally circular about a horizontal axis 21 (FIGS. 4 and 5) lying in a vertical plane 34 (FIG. 2). The axis 21 is the axis of the volute 25 (FIG. 3) in which the impeller (not shown) resides and rotates. The tube receivers 17 and 22 are generally cylindrical as are the tubes 14 and 23, and their axes 36 and 37 lie in a vertical plane 38 (FIGS. 4 and 5) which is perpendicular to the pump axis 21 as the lower portion of each tube is inserted as at 39 in FIG. 2 for tube 23, into the tube receiver 22. The tube axes 36 and 37 are equally spaced from and on opposite sides of the plane 34.

A flange 41 is welded to the exterior of tube 23. It is apertured at the four corners and receives the stem of a cap screw 42 at each corner and which is screwed into the pump case at four corners of a square around the receptacle receiving the tue (FIG. 5). Exactly the same mounting is provided for tube 14 as shown for tube 23. Therefore, a description of the sealing of tube 14 will suffice also for tube 23. In this case, there is an upwardly opening cylindrical bore 43 in the receptacle 17 and which receives the tube 14 in a loose sliding fit. A radially inward extending shoulder 44 at the bottom of bore 43 receives and supports an elastomeric seal ring 45 of rectangular cross section therein. The lower end 46 of the tube 14 is disposed on top of the seal 45. It seals completely around the end of the tube when the cap screws 42 are screwed into the pump case at the four corners around the tube 14.

The rear of the pump case has a double flanged adaptor 47 secured to it by circularly spaced can screws (not shown) bearing on flange 47A. The pump drive motor 48 is secured to the adaptor by a series of circularly spaced cap screws (not shown) bearing on flange 47B. The pump case has a rectangular mounting base 51 with four bolt holes in the corners thereof as at 52 to receive bolts to mount it to a mounting pad in either a stationary unit or a mobile cabinet. This arrangement is sufficient to support the motor 48 without any brace at the outer end of the motor.

Figure 3:
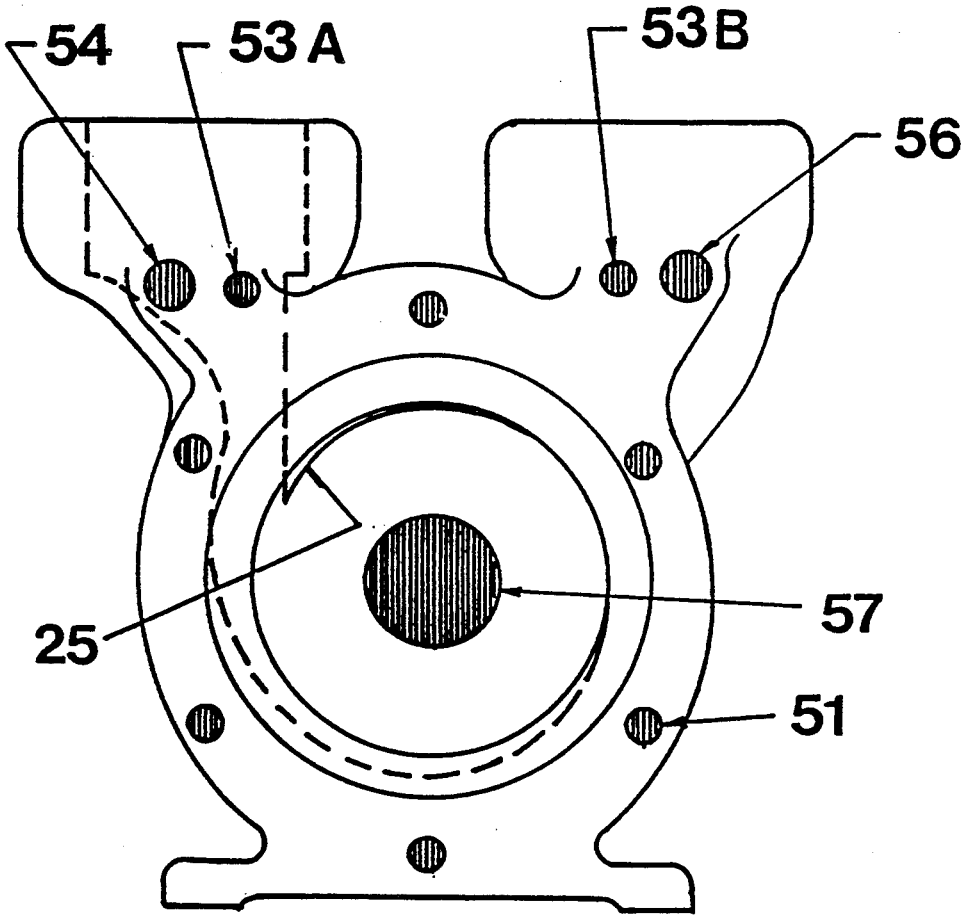
FIG. 3 is an elevational view of the motor end of the pump case but omitting the motor, adaptor plate and pump impeller.

In FIG. 3, where the front of the pump case is shown with the motor and adaptor removed from it, the tap bolt holes 51 are shown in a circle of six. Additional tapped holes are shown at 53A and 53B for connection to input and output pressure gauges (not shown). A tapped hole 54 is provided for a pressure relief valve. The tapped hole 56 is provided for connection of a temperature sensor. The central opening 57 on the pump axis is shown cross-hatched to indicate shading, not a screen.

Figure 6:
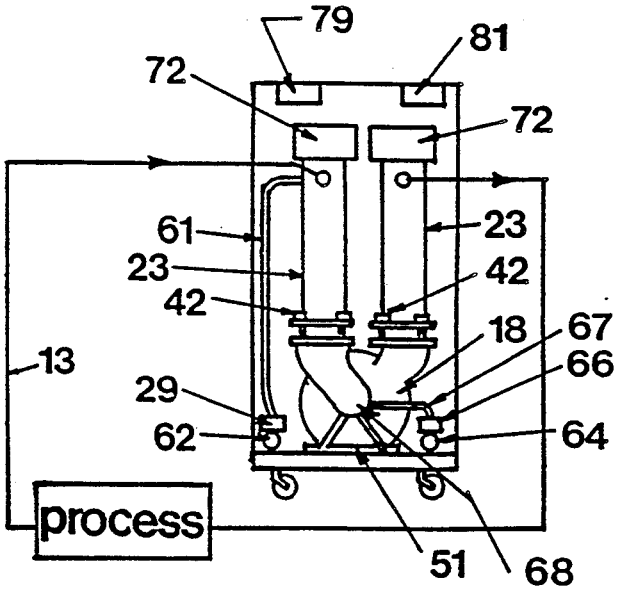
FIG. 6 is a rear end elevational view of a complete machine employing the pump and heat exchanger assembly of the present invention in an "open circuit" process water system.
Figure 7:
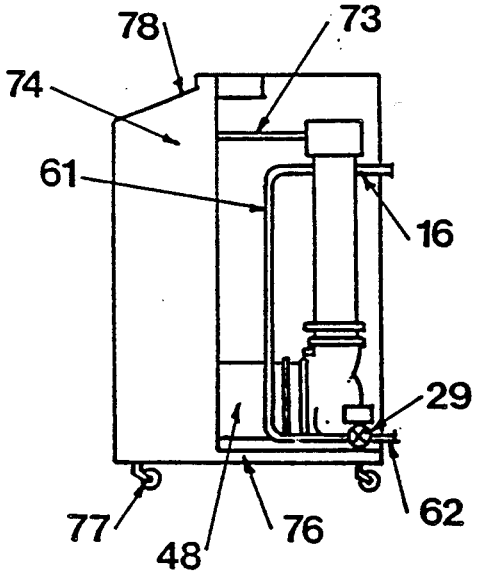
FIG. 7 is a side elevational view thereof.

Referring now to FIGS. 6 and 7, there is shown an "open circuit" embodiment of the invention. In this case, instead of using a separate coil such as 26 for the cooling water, the cooling is achieved, when necessary, by discharging process water to drain and supplying fresh water from a public utility, for example, directly into the process water circuit. In this embodiment, the pump case may be exactly the same as in the previously described embodiment. It is shown with a slightly more specifically defined flange at the top of the pump case where the tube receiver receptacles are located. Hat exchanger tube 23 is identical and is mounted in an identical fashion with the cap screws 42. In this embodiment, the heat exchanger tube 23 at the intake site of the pump is identical to that at the pump discharge side. This enables doubling the heating capacity of the assembly without any change of dimension. If desired, of course, the tube at the intake side can be essentially identical to that at the output side but without the electrical heating element in it. In any case, the mounting is the same as previously described with reference to the first embodiment. In this instance however, the heat exchanger tube 23 at the pump input side and which receives the water from the process through line 13, has an outlet line 61 connected to a spud opening at the back of the tube 23 directly behind inlet opening 16 at the front. This line is connected through electrically controlled valve assembly 29 which is normally closed. The outlet side of the valve at 62 is at the rear of the machine for connection to a drain just as the valve 29 in the FIG. 1 embodiment discharges to a sewer. Make-up water from a city water supply as at 28 in FIG. 1, is supplied through input line 64 and electrically operated valve, if desired, at 66, and the supply line 67 into the threaded hole 68 at the bottom of the intake passageway of the pump case and which, in the closed circuit version of FIG. 1 has a plug 69 in it. The pump case drain opening is plugged with a plug 71 in this embodiment just as in the previous embodiment.

If it is desired to double the heating capacity of the unit, both of the heat exchanger tubes are identical and each may have a junction box 72 at the upper end thereof, both of which are connected as by a line 73 into the control cabinet 74. All of this apparatus is mounted on a base 76 which , in this embodiment, is mounted on four caster assemblies 77. As in the first described embodiment, the pump case itself provides the total support for the motor 48, without any additional support at the outer end of the motor, part of which is extending inside the cabinet 74 as best shown in FIG. 7. The cabinet may have a control panel 78 at the top front, and the two pressure gauges 79 and 81 in the top of the cabinet are readily observable to the operator. Theses may be connected as by pilot lines to the threaded ports 53A and 53B described above with reference to FIG. 3.

The pump case is cast iron. The heat exchanger tubes are steel. The whole unit is much small than others known to us for a given heating capacity. By using 9 KW heating elements in each tube, the machine can have 18 KW heating capacity using 3 inch diameter tubes about 14 inches long.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A heat transfer apparatus comprising:

a pump assembly having an impeller case with a volute about a horizontal axis;

the case having upwardly facing circular tube receivers having centers in a first vertical plane perpendicular to the volute axis, the centers being on opposite sides of a second vertical plane containing the volute axis;

a first tube received in one of the receivers and having heater means therein, the tube having at least one plate projecting horizontally outward; and fastener means mounted to the case and to the plate to secure the tube in the one receiver.

2. The apparatus of claim 1 and further comprising:

an upwardly-facing shoulder in the one receiver;

a seal ring on the shoulder and compressed by the end of the tube and sealing the end of the tube to the case in the receiver.

3. The apparatus of claim 2 and wherein the plate projects radially outwardly from the first tube; and additional fastener means engage the plate and case at circularly spaced locations around the first tube and secure the first tube to the case.

4. The apparatus of claim 3 wherein:

said fastener means are screws threaded into the case and pulling the first tube into tight sealing engagement with the seal ring.

5. The apparatus of claim 1 and further comprising:

a second tube received in another of the receivers and having at least one bracket projecting horizontally outward; and further fastener means mounted to the case and to the bracket and securing the second tube in the other receiver.

6. The apparatus of claim 5 and further comprising:

an upwardly facing shoulder in the other receiver;

a second seal ring on the shoulder in the groove in the other receiver and compressed by the end of the second tube and sealing the end of the second tube to the case in the other receiver.

7. The apparatus of claim 6 and further comprising:

heating means in said second tube.

8. The apparatus of claim 1 and further comprising;

a base;

a cabinet mounted on the base, and the pump case being mounted on the base.

9. The apparatus of claim 8 and further comprising:

a pump drive motor fastened to the case and having a motor axis colinear with the volute axis, the pump motor being supported exclusively by the pump case.

* * * * *